US012735155B2

(12) United States Patent
Binkowski et al.

(10) Patent No.: US 12,735,155 B2
(45) Date of Patent: Sep. 15, 2026

(54) SYSTEMS AND METHODS FOR STEERING A WATERCRAFT

(71) Applicant: Arc Boat Company, San Francisco, CA (US)

(72) Inventors: Robert Binkowski, San Francisco, CA (US); Hsin Yu Wei, San Francisco, CA (US); Andrew Phillips, San Francisco, CA (US)

(73) Assignee: Arc Boat Company, San Francisco, CA (US)

( * ) Notice: Subject to any disclaimer, the term of this patent is extended or adjusted under 35 U.S.C. 154(b) by 16 days.

(21) Appl. No.: 19/042,925

(22) Filed: Jan. 31, 2025

(65) Prior Publication Data

US 2025/0249991 A1 Aug. 7, 2025

Related U.S. Application Data

(60) Provisional application No. 63/548,640, filed on Feb. 1, 2024.

(51) Int. Cl.
*B63B 79/40* (2020.01)
*B63B 79/10* (2020.01)
(Continued)

(52) U.S. Cl.
CPC ..... *B63B 79/40* (2020.01); *B63B 79/10* (2020.01); *B63H 21/21* (2013.01); *B63H 25/38* (2013.01); *B63B 2213/02* (2013.01)

(58) Field of Classification Search
CPC ..... B63B 79/40; B63B 79/10; B63B 2213/02; B63H 21/21; B63H 25/38
(Continued)

(56) References Cited

U.S. PATENT DOCUMENTS 5,016,553 A 5/1991 Spencer
6,009,822 A 1/2000 Aron
(Continued)

FOREIGN PATENT DOCUMENTS

EP 4280014 11/2023
EP 4309996 A1 1/2024
(Continued)

OTHER PUBLICATIONS

International Search Report & Written Opinion for international patent application PCT/US2025/013967; mailed Apr. 14, 2025; 11 pages.

*Primary Examiner* — Luis A Martinez Borrero
(74) *Attorney, Agent, or Firm* — Casimir Jones, S.C.; Brian F. Bradley

(57) ABSTRACT

A system and method of steering a watercraft. The method comprising determining an estimated speed, an estimated yaw, and an estimated yaw rate of change of a watercraft based on a first output from a GPS and a second output from an inertial measurement unit; adjusting a position of a rudder coupled to a hull of the watercraft based on a position of a steering wheel; determining a desired yaw rate of change of a hull based on the position of the steering wheel and the estimated speed; energizing a propeller to provide a propelling force on the hull; and energizing a thruster coupled to the hull based on an error between the desired yaw rate of change and the estimated yaw rate of change.

20 Claims, 6 Drawing Sheets

(51) Int. Cl.
*B63H 21/21* (2006.01)
*B63H 25/38* (2006.01)

(58) Field of Classification Search
USPC ..... 701/21
See application file for complete search history.

(56) References Cited

U.S. PATENT DOCUMENTS 6,230,642 B1 5/2001 McKenney et al.
6,357,375 B1 3/2002 Ellis
6,363,875 B1 4/2002 Griffith, Sr. et al.
6,538,217 B1 3/2003 Eriksen et al.
7,267,068 B2 9/2007 Bradley et al.
7,305,928 B2 12/2007 Bradley et al.
7,398,742 B1 7/2008 Gonring
7,404,369 B2 7/2008 Tracht et al.
7,467,595 B1 12/2008 Lanyi et al.
7,641,525 B2 * 1/2010 Morvillo ..... B63B 39/00 440/42
7,727,036 B1 * 6/2010 Poorman ..... B63H 21/22 440/1
8,145,371 B2 * 3/2012 Rae ..... B63B 79/10 701/21
8,162,706 B2 4/2012 Mizutani et al.
8,170,734 B2 5/2012 Kaji
8,170,735 B2 5/2012 Kaji
8,417,399 B2 4/2013 Arbuckle et al.
8,478,464 B2 7/2013 Arbuckle et al.
8,480,445 B2 * 7/2013 Morvillo ..... B63B 39/00 440/40
8,924,054 B1 * 12/2014 Arbuckle ..... B63H 21/21 701/518
8,943,988 B1 * 2/2015 Guglielmo ..... B63H 21/21 114/163
8,965,606 B2 * 2/2015 Mizutani ..... B63H 21/22 701/21
9,039,468 B1 * 5/2015 Arbuckle ..... B63B 49/00 440/79
9,248,898 B1 * 2/2016 Kirchhoff ..... B63B 49/00
9,733,645 B1 * 8/2017 Andrasko ..... B63H 25/02
9,809,292 B1 11/2017 Gonring
9,828,075 B1 11/2017 Hartman
10,095,232 B1 10/2018 Arbuckle et al.
10,322,787 B2 6/2019 Ward
10,324,468 B2 6/2019 Arbuckle et al.
10,331,137 B2 6/2019 Miller et al.
10,437,248 B1 10/2019 Ross et al.
10,633,072 B1 4/2020 Arbuckle et al.
10,640,190 B1 5/2020 Gonring
10,671,073 B2 6/2020 Arbuckle et al.
10,717,502 B1 7/2020 Hartman
10,782,690 B1 9/2020 Miller et al.
10,787,238 B2 9/2020 Watanabe et al.
10,795,366 B1 10/2020 Arbuckle et al.
10,829,191 B2 11/2020 Wong et al.
10,845,811 B1 11/2020 Arbuckle et al.
10,913,524 B1 2/2021 Wald et al.
10,926,855 B2 2/2021 Derginer et al.
11,021,220 B2 6/2021 Yamamoto et al.
11,091,243 B1 8/2021 Gable et al.
11,247,753 B2 * 2/2022 Arbuckle ..... B63B 79/10
11,260,949 B2 3/2022 Ward
11,327,494 B1 5/2022 Arbuckle et al.
11,383,815 B1 7/2022 Miller et al.
11,565,783 B1 1/2023 Wald et al.
11,655,015 B1 5/2023 Gable et al.
11,820,481 B2 11/2023 Bondesson et al.
11,827,329 B1 11/2023 Miller et al.
11,904,997 B1 2/2024 Wald et al.
12,006,015 B2 6/2024 Christensen et al.
12,065,230 B1 8/2024 Derginer et al.
12,084,160 B2 9/2024 Derginer et al.
12,110,088 B1 10/2024 Derginer et al.
12,252,224 B2 * 3/2025 Arbuckle ..... B63B 79/10
2006/0217011 A1 * 9/2006 Morvillo ..... B63B 39/00 440/40
2007/0032923 A1 * 2/2007 Mossman ..... G05D 1/0858 701/4
2009/0171520 A1 * 7/2009 Kaji ..... B63H 20/12 701/21
2010/0023192 A1 * 1/2010 Rae ..... B63H 25/04 342/357.74
2010/0070119 A1 * 3/2010 Morvillo ..... B63B 39/00 440/40
2013/0340667 A1 * 12/2013 Morvillo ..... B63B 39/00 114/150
2017/0139426 A1 * 5/2017 Ito ..... B63B 79/10
2017/0210453 A1 * 7/2017 Morvillo ..... B63B 39/00
2017/0300056 A1 * 10/2017 Johnson ..... B63H 25/04
2018/0231980 A1 * 8/2018 Arbuckle ..... B63B 79/10
2019/0176948 A1 * 6/2019 Morvillo ..... B63B 39/00
2019/0283855 A1 9/2019 Nilsson
2020/0249678 A1 * 8/2020 Arbuckle ..... B63B 79/10
2020/0369356 A1 * 11/2020 Morvillo ..... B63B 39/00
2021/0035480 A1 2/2021 Zou et al.
2021/0061422 A1 3/2021 Hartman
2022/0161908 A1 * 5/2022 Arbuckle ..... B63B 79/10
2022/0266974 A1 8/2022 Sakurada
2022/0363359 A1 * 11/2022 Morvillo ..... B63B 39/00
2023/0150643 A1 * 5/2023 Weber ..... B63H 25/04 701/21
2024/0109630 A1 * 4/2024 Morvillo ..... B63B 39/00
2024/0270368 A1 8/2024 Christensen et al.
2024/0336344 A1 10/2024 Christensen et al.
2025/0382040 A1 * 12/2025 Arbuckle ..... B63B 79/10

FOREIGN PATENT DOCUMENTS

JP 2013032161 2/2013
JP 2016159804 9/2016
WO 2006062416 A1 6/2006

* cited by examiner

SYSTEMS AND METHODS FOR STEERING A WATERCRAFT

CROSS REFERENCE TO RELATED APPLICATIONS

This application claims priority to and the benefit of U.S. Provisional Patent Application No. 63/548,640, filed Feb. 1, 2024, which is incorporated herein by reference in its entirety for all purposes.

TECHNICAL FIELD

This disclosure relates to steering systems for watercraft (e.g., boats) and methods of using the same.

BACKGROUND

Prop walk is a turning force on a boat caused by the rotation of the propeller. Prop walk is different on every boat but is most noticeable at low speeds when going in reverse.

Prop wash is an accentuated turning effect of the rudder when the propeller is spinning. The force of water generated by the propeller in a forward direction "washes" over the rudder, moving the bow starboard.

SUMMARY

The disclosure provides, in one aspect, a method comprising determining an estimated speed, an estimated yaw, and an estimated yaw rate of change of a watercraft based on a first output from a GPS and a second output from an inertial measurement unit. The method further comprises adjusting a position of a rudder coupled to a hull of the watercraft based on a position of a steering wheel; determining a desired yaw rate of change of the hull based on the position of the steering wheel and the estimated speed; energizing a propeller to provide a propelling force on the hull; and energizing a thruster coupled to the hull based on an error between the desired yaw rate of change and the estimated yaw rate of change.

In some embodiments, the estimated speed and the estimated yaw of the watercraft is determined with a fusion of the first output from the GPS and the second output from the inertial measurement unit.

In some embodiments, the fusion of the first output from the GPS and the second output from the inertial measurement unit is with an extended Kalman filter.

In some embodiments, the first output from the GPS comprises a GPS-estimated speed, a GPS-estimated latitude, a GPS-estimated longitude; a GPS-estimated altitude; a GPS-estimated course; and a dilution of precision.

In some embodiments, the second output from the inertial measurement unit includes 3-axis acceleration; 3-axis angular rate of rotation, and 3-axis magnetic field strength.

In some embodiments, the inertial measurement unit is positioned within the hull; and the second output from the inertial measurement unit has been calibrated for iron cancellations.

In some embodiments, the method further comprises determining an estimated course of the watercraft based on the first output from the GPS and the second output from the inertial measurement unit; and wherein determining the desired yaw rate of change is based on the position of the steering wheel, the estimated speed, and the estimated course.

In some embodiments, the desired yaw rate of change is inversely correlated to the estimated speed.

In some embodiments, the thruster is a first thruster and the method further includes energizing a second thruster coupled to the hull based on the error between the desired yaw rate of change and the estimated yaw rate of change; and wherein the propeller is positioned between the first thruster and the second thruster.

The disclosure provides, in one aspect, a watercraft comprising a hull defining a center bow-stern axis; a user input device; a throttle; an inboard motor coupled to a propeller; wherein the propeller is positioned along the center bow-stern axis; and wherein the propeller is energized based on a throttle position of the throttle to provide a propelling force on the hull; a first thruster coupled to the hull; and a second thruster coupled to the hull. The propeller is positioned between the first thruster and the second thruster along the bow-stern axis. The watercraft further comprises a rudder coupled to the hull and adjustable about a rudder axis; wherein the rudder is positioned based on a position of the user input device; a GPS system generating a first output; and an inertial measurement unit generating a second output. The first thruster or the second thruster is energized based on the first output and the second output.

In some embodiments, the first thruster and the second thruster are energized based on the first output and the second output.

In some embodiments, the first thruster or the second thruster is energized to negate a drifting motion caused by the propeller.

In some embodiments, the watercraft further comprises a processor configured to determine an estimated speed, an estimated yaw, and an estimated yaw rate of change based on the first output from the GPS system and the second output from the inertial measurement unit; and wherein the processor is further configured to determine a desired yaw rate of change of the hull based on the position of the user input device; and wherein the first thruster or the second thruster is energized based on an error between the desired yaw rate of change and the estimated yaw rate of change.

In some embodiments, the watercraft further comprises a processor and wherein a throttle of the first thruster, a throttle of the second thruster, a position of the rudder about the rudder axis, and a throttle of the propeller are adjustable by the processor.

In some embodiments, the user input device is a steering wheel.

In some embodiments, the inertial measurement unit is positioned in a bow portion of the hull.

In some embodiments, the watercraft further comprises a camera that captures an image of a surrounding of the watercraft; and wherein the first thruster or the second thruster is energized based on the image.

In some embodiments, the first thruster and the second thruster have an adjustable output power; and wherein the orientation of the first thruster and the orientation of the second thruster are fixed relative to the hull.

The disclosure provides, in one aspect, a method comprising determining a desired trajectory of a hull of a watercraft based on a position of a steering wheel and a position of a throttle; wherein the desired trajectory is a reverse trajectory or a forward trajectory; adjusting a position of a rudder coupled to the hull based on the position of the steering wheel; energizing a propeller based on the position of the throttle to provide a propelling force on the hull; and energizing a first thruster and a second thruster coupled to the hull to negate a drifting motion of the hull caused by the propeller; wherein the propeller is positioned between the first thruster and the second thruster.

In some embodiments, the method further comprises determining an estimated drifting motion caused by the propeller based on a first output from a GPS and a second output from an inertial measurement unit.

Other aspects of the disclosure will become apparent by consideration of the detailed description and accompanying drawings.

BRIEF DESCRIPTION OF THE DRAWINGS

These and other features, aspects, and advantages of the present technology will become better understood with regards to the following drawings. The accompanying figures and examples are provided by way of illustration and not by way of limitation.

Before any embodiments are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Unless otherwise defined, all technical and scientific terms used herein have the same meaning as commonly understood by one of ordinary skill in the art. In case of conflict, the present document, including definitions, will control. Preferred methods and materials are described below, although methods and materials similar or equivalent to those described herein can be used in practice or testing of the present disclosure. All publications, patent applications, patents and other references mentioned herein are incorporated by reference in their entirety.

The materials, methods, and examples disclosed herein are illustrative only and not intended to be limiting.

The terms "comprise(s)," "include(s)," "having," "has," "can," "contain(s)," and variants thereof, as used herein, are intended to be open-ended transitional phrases, terms, or words that do not preclude the possibility of additional acts or structures. The singular forms "a," "an" and "the" include plural references unless the context clearly dictates otherwise. The present disclosure also contemplates other embodiments "comprising," "consisting of" and "consisting essentially of," the embodiments or elements presented herein, whether explicitly set forth or not.

For the recitation of numeric ranges herein, each intervening number there between with the same degree of precision is explicitly contemplated. For example, for the range of 6-9, the numbers 7 and 8 are contemplated in addition to 6 and 9, and for the range 6.0-7.0, the number 6.0, 6.1, 6.2, 6.3, 6.4, 6.5, 6.6, 6.7, 6.8, 6.9, and 7.0 are explicitly contemplated.

The term "coupled," as used herein, is defined as "connected," although not necessarily directly, and not necessarily mechanically. The term coupled is to be understood to mean physically, magnetically, chemically, fluidly, electrically, or otherwise coupled, connected or linked and does not exclude the presence of intermediate elements between the coupled elements absent specific contrary language.

Figure 4:
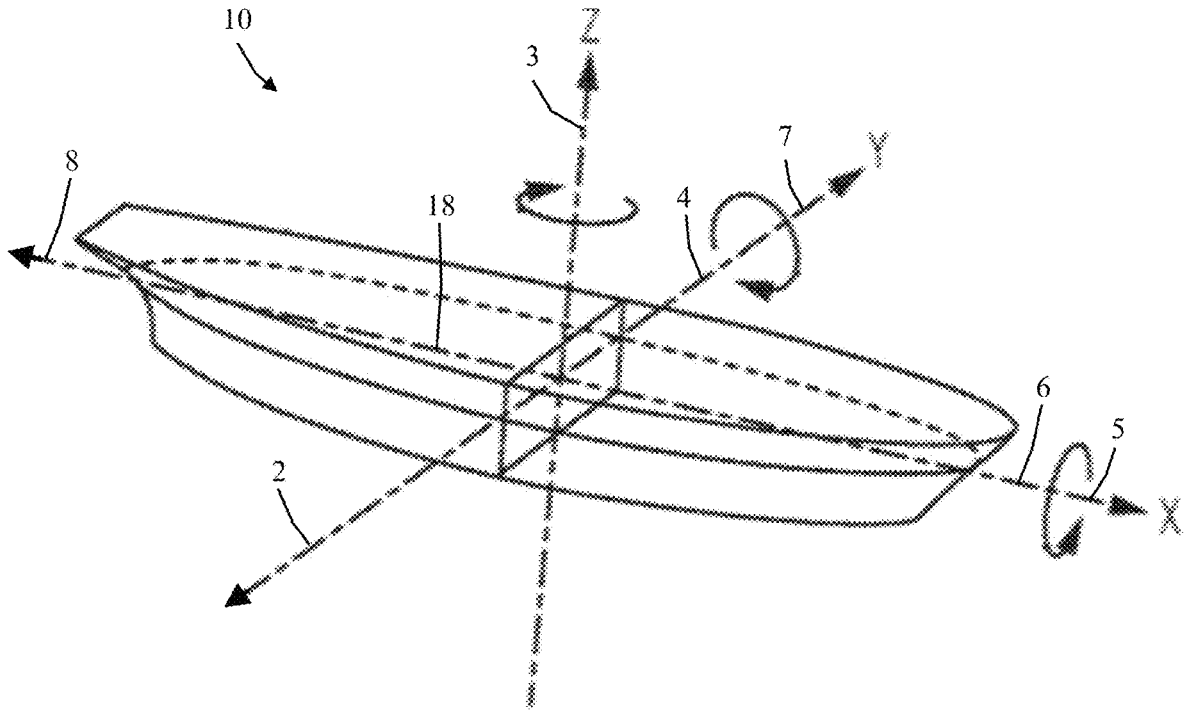
FIG. 4 is a schematic of a watercraft with axes of motion and rotation identified.

To facilitate the understanding of this disclosure, a number of marine terms are defined below. Terms defined herein have meanings as commonly understood by a person of ordinary skill in the areas relevant to the present disclosure. "Starboard" refers to the right-hand, or driver's, side of the watercraft. "Port" refers to the left-hand, or passenger's, side of the watercraft. "Bow" refers to the front of the watercraft. "Transom" and "stern" refer to the rear of the watercraft. The starboard 2, port 4, bow 6, and stern 8 directions are illustrated in FIG. 4 for reference. A yaw axis of rotation 3, a roll axis of rotation 5, and a pitch axis of rotation 7 are also illustrated in FIG. 4 for reference.

As used herein, the term "motor" includes any primary driver including, but not limited to, electrical motors, electric machines, and internal combustion engines.

As used herein, the terms "processor", "controller", "central processing unit" or "CPU" are used interchangeably and refer to a device that is able to read a program from a computer memory (e.g., ROM or other computer memory) and perform a set of steps according to the program. As used herein, the term "processor" (e.g., a microprocessor, a processing unit, or other suitable programmable device) can include, among other things, a control unit, an arithmetic logic unit ("ALU"), and a plurality of registers, and can be implemented using a known computer architecture (e.g., a modified Harvard architecture, a von Neumann architecture, etc.). In some embodiments the processor is a microprocessor that can be configured to communicate in a stand-alone and/or a distributed environment, and can be configured to communicate via wired or wireless communications with other processors, where such one or more processor can be configured to operate on one or more processor-controlled devices that can be similar or different devices.

As used herein, the term "memory" is any memory storage and is a non-transitory computer readable medium. The memory can include, for example, a program storage area and the data storage area. The program storage area and the data storage area can include combinations of different types of memory, such as a ROM, a RAM (e.g., DRAM, SDRAM, etc.), EEPROM, flash memory, a hard disk, a SD card, or other suitable magnetic, optical, physical, or electronic memory devices. The processor can be connected to the memory and execute software instructions that are capable of being stored in a RAM of the memory (e.g., during execution), a ROM of the memory (e.g., on a generally permanent basis), or another non-transitory computer readable medium such as another memory or a disc. In some embodiments, the memory includes one or more processor-readable and accessible memory elements and/or components that can be internal to the processor-controlled device, external to the processor-controlled device, and can be accessed via a wired or wireless network. Software included in the implementation of the methods disclosed herein can be stored in the memory. The software includes, for example, firmware, one or more applications, program data, filters, rules, one or more program modules, and other executable instructions. For example, the processor can be configured to retrieve from the memory and execute, among other things, instructions related to the processes and methods described herein.

As used herein, the term "computer readable medium" refers to any device or system for storing and providing information (e.g., data and instructions) to a computer processor. Examples of computer readable media include, but are not limited to, DVDs, CDs, hard disk drives, magnetic tape, and servers for streaming media over networks, whether local or distant (e.g., cloud-based).

Figure 1:
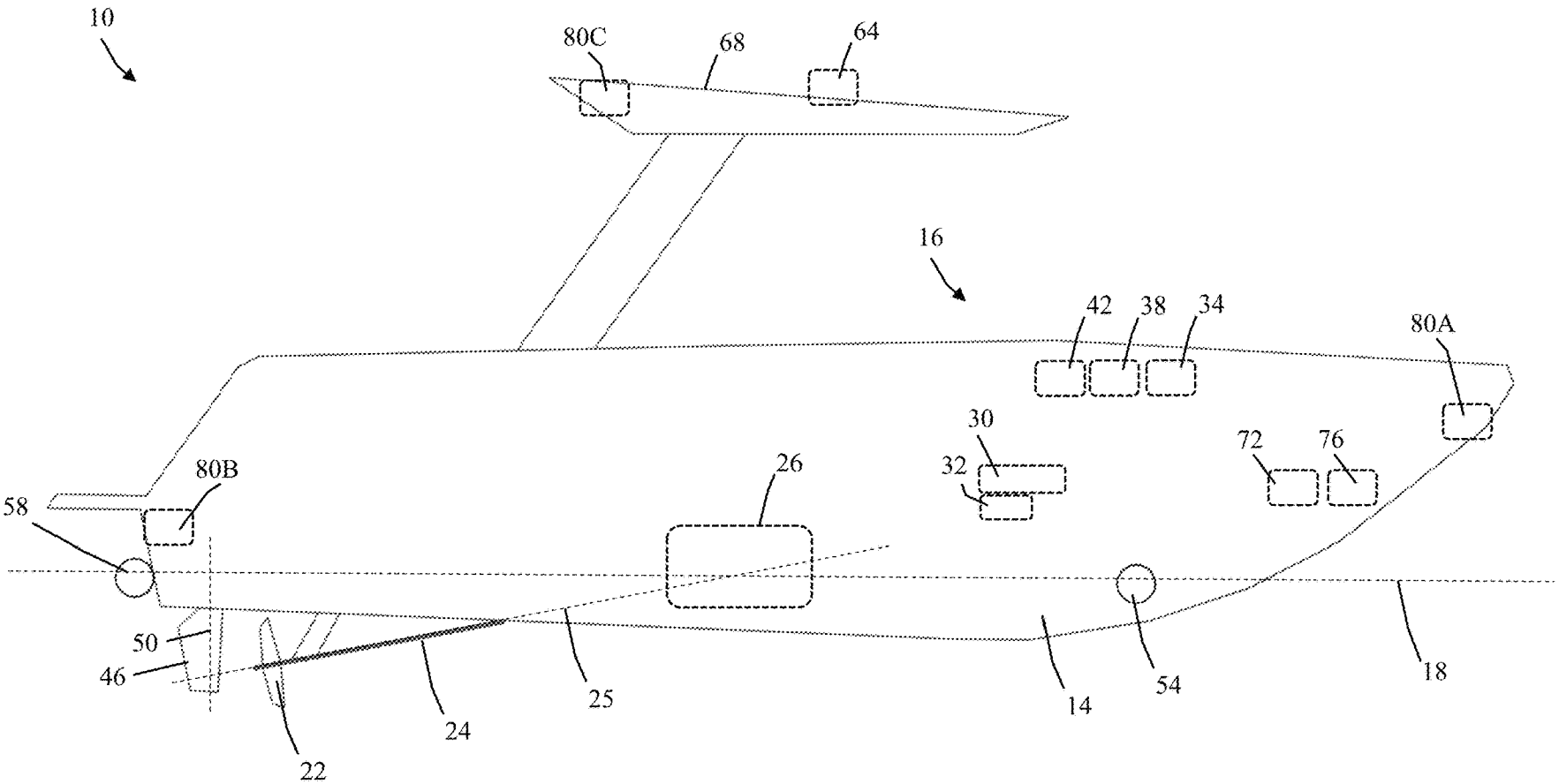
FIG. 1 is a side view of a watercraft with a propeller, a stern thruster, and a bow thruster.

With reference to FIG. 1, a watercraft 10 includes a hull 14 that defines a center bow-stern axis 18. In the illustrated embodiment, the watercraft 10 is propelled through the water by a propeller 22 that is rotationally driven by an electric drive. In some embodiments, the electric drive includes an electric motor 26 (e.g., an induction motor, a synchronous motor, a brushless DC motor, a permanent magnet rotor, an interior permanent magnet motor, a surface permanent magnet motor, a reluctance motor, etc.) and a power converter (e.g., an inverter, a converter, etc.). In the illustrated embodiment, a driveshaft 24 extends from the hull 14 along an axis 25 and is rotationally coupled to the propeller 22. In the illustrated embodiment, the driveshaft 24 extends between the inboard electric motor 26 and the propeller 22. In some embodiments, the watercraft 10 includes a battery electrically coupled to the electric drive. In some embodiments, the propeller 22 is coupled to an inboard motor, an outboard motor, or a sterndrive.

With continued reference to FIG. 1, the propeller 22 is positioned along the center bow-stern axis 18. In other words, the propeller 22, in the illustrated embodiment, is positioned along and aligned with the bow-stern axis 18 of the watercraft 10. The propeller 22 is configured to propel the watercraft 10 in a forward or reverse direction when the propeller 22 is energized (e.g., rotationally driven). In some embodiments, the propeller 22 is the only source of forward propulsion for the watercraft 10. In other embodiments, the watercraft includes more than one propeller for providing forward propulsion. In some embodiments, the watercraft includes two propellers that are each positioned spaced from the center bow-stern axis.

In the illustrated embodiment, the watercraft 10 includes a processor 30, a memory 32 storing machine-readable instructions, and a user input device 34 configured to receive an input from a user regarding a desired trajectory of the watercraft 10. In other words, a steering input by the user is received at the user input device 34. In the illustrated embodiment, a desired trajectory of the watercraft 10 is based on a position of the user input device 34. In some embodiments, the user input device 34 is a steering wheel. In some embodiments, the user input device 34 is a joystick, a puck, or other suitable user interface device. In some embodiments, the desired trajectory is a reverse trajectory (e.g., in a stern direction). In some embodiments, the desired trajectory is a forward trajectory (e.g., in a bow direction). In some embodiments, the watercraft 10 further comprises a motion selector 38 to allow the operator to choose between forward and reverse directions. In the illustrated embodiment, the desired trajectory is based on a user input to the motion selector 38 (e.g., a forward motion or a reverse motion). In the illustrated embodiment, the watercraft 10 includes a throttle 42 configured to adjust the output power to the propeller 22, and therefore the speed of the watercraft 10. In some embodiments, the motion selector 38 is integrated into the throttle 42 such that forward displacement of the throttle 42 represents a desired forward trajectory and reverse displacement of the throttle 42 represents a desired reverse trajectory. In some instances, when the watercraft 10 is moving in a reverse direction (e.g., with a reverse course), forward displacement of the throttle 42 by the user represents a desire to slow down the reverse course. Similarly, when the watercraft 10 is moving in a forward direction (e.g., with a forward course), reverse displacement of the throttle 42 by the user represents a desire to slow down the forward course.

In the illustrated embodiment, a plurality of user input devices (e.g., user input device 34, motion selector 38, throttle 42, etc.) are electrically coupled to the processor 30. In the illustrated embodiment, the processor 30 receives electrical signals based on user input or inputs received at the user input device 34, the motion selector 38, and the throttle 42. In some embodiments, the desired trajectory of the watercraft 10 is based on the input or inputs received at the user input device 34, the motion selector 38, the throttle 42, or any combination thereof.

Figure 2:
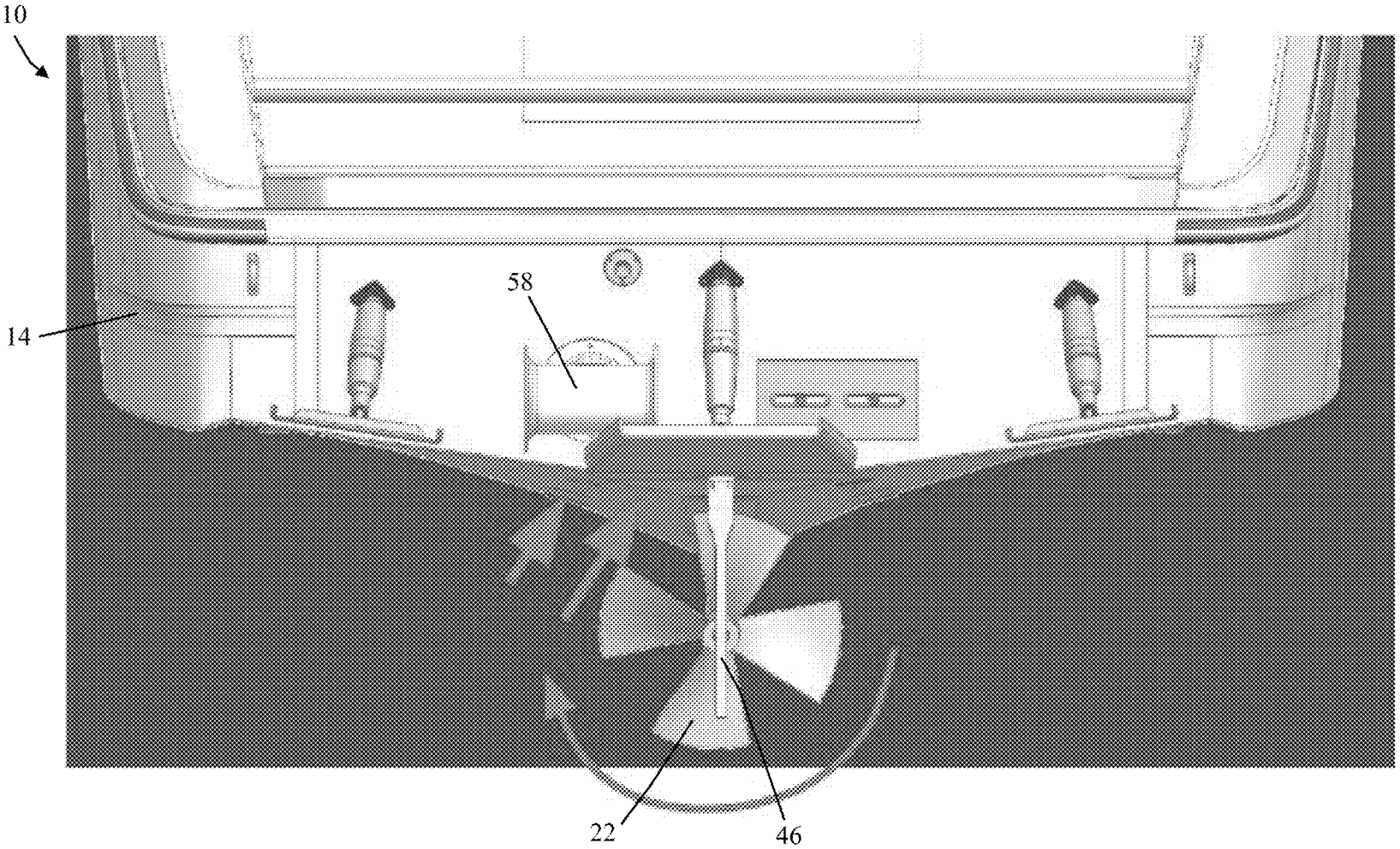
FIG. 2 is a rear view of a propeller and a rudder on a watercraft.

With reference to FIGS. 1 and 2, the watercraft 10 is at least partially steered through the water with adjustment of a rudder 46 about a rudder axis 50 in response to movement of a steering wheel, for example. In the illustrated embodiment, the rudder 46 is coupled to the hull 14 and adjustable about the rudder axis 50. In the illustrated embodiment, the rudder 46 is controlled by the processor 30 to move about the rudder axis 50 based on an input or inputs from the user input device 34. As such, the rudder 46 is positioned based on a desired trajectory of the watercraft 10. In the illustrated embodiment, the rudder axis 50 intersects the axis 25 of the driveshaft 24.

Figure 3:
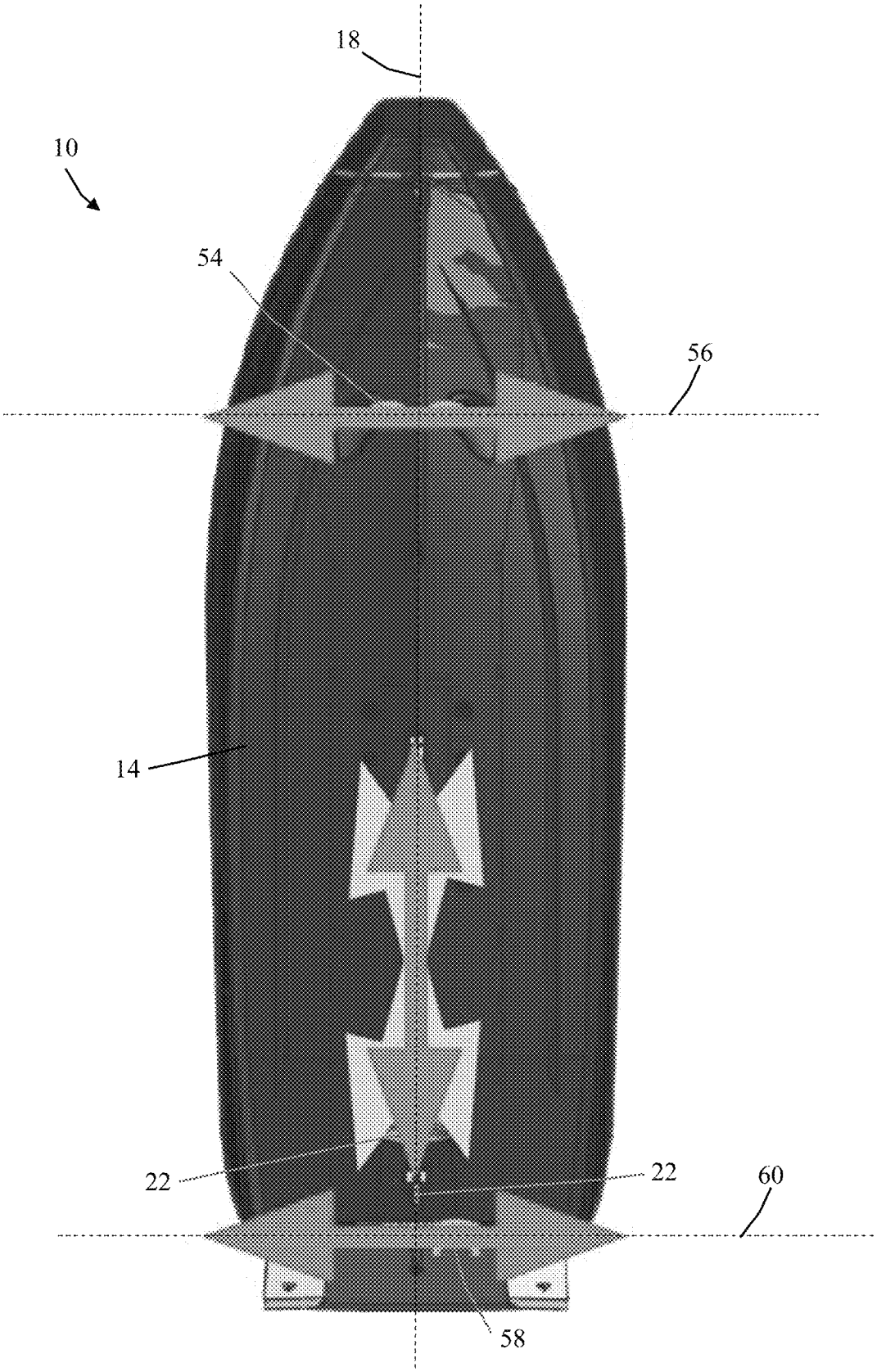
FIG. 3 is a bottom view of the watercraft of FIG. 1.

With continued reference to FIGS. 1 and 3, the watercraft 10 includes a first thruster 54 coupled to the hull 14 and a second thruster 58 coupled to the hull 14. In the illustrated embodiment, the first thruster 54 is a bow thruster, and the second thruster 58 is a stern thruster. The propeller 22 is positioned between the first thruster 54 and the second thruster 58 along the bow-stern axis 18. In other words, at least one thruster is positioned forward of the propeller 22 (e.g., thruster 54) and at least one thruster is positioned behind the propeller 22 (e.g., thruster 58). In the illustrated embodiment, the first thruster 54 is oriented along a first thruster axis 56 and the second thruster 58 is oriented along a second thruster axis 60. In some embodiments, the first thruster axis 56 and the second thruster axis 60 are parallel. In some embodiments, the first thruster axis 56 is orthogonal to the bow-stern axis 18. In some embodiments, the second thruster axis 60 is orthogonal to the bow-stern axis 18.

The first thruster 54 is embedded in the hull 14 and the second thruster 58 is embedded in the hull 14. In the illustrated embodiment, the orientation of the first thruster 54 and the orientation of the second thruster 58 are fixed relative to the hull 14. In some embodiments, the first thruster 54 and the second thruster 58 have an adjustable output power. In the illustrated embodiment, the first thruster 54 has an unexposed thruster propeller (e.g., a propeller within a tube, housing, or encasing). Likewise, the second thruster 58 an unexposed thruster propeller. As such, the thrusters 54, 58 are energized and the internal propellers rotate without having exposed rotating parts. In some embodiments, the thrusters are BOW PRO 48 VDC thrusters available from VETUS.

With continued reference to FIG. 1, the watercraft 10 includes a GPS system 64 configured to generate a first output and an inertial measurement unit (IMU) 72 configured to generate a second output. As detailed herein, in some embodiments, the first output from the GPS system 64 and the second output from the IMU 72 are fused together to estimate the state of the watercraft 10. For example, in some embodiments, an estimated speed and an estimated yaw of the watercraft 10 is determined with a fusion of the first output from the GPS system 64 and the second output from the IMU 72. In some embodiments, the fusion of the first output from the GPS and the second output from the IMU is with an extended Kalman filter.

The first output from the GPS system 64 is received by the processor 30 and may include, among other things, an estimated position. In some embodiments, the first output from the GPS system 64 comprises a GPS-estimated speed, a GPS-estimated latitude, a GPS-estimated longitude, a GPS-estimated altitude; a GPS-estimated course, and a dilution of precision based on the number of connected satellites. In some embodiments, the first output from the GPS system 64 comprises a GPS-estimated speed vector. In some embodiments, the GPS system 64 is positioned on a tower assembly 68. The GPS-estimated course is the direction in which the watercraft is moving and may be different from the direction in which the watercraft is pointing. However, the GPS-estimated course is only accurate when the watercraft is moving above a speed threshold, making the GPS-estimated course not ideal for low-speed operations. The dilution of precision based on the number of connected satellites may be used to determine the quality of the GPS signal. Dilution of precision may be caused by, for example, the watercraft moving under a bridge. When the dilution of precision is high, the confidence in the GPS measurements is reduced.

The second output from the IMU 72 is received by the processor 30 and may include, among other things, an estimated acceleration and rate of angular rotation. In some embodiments, the IMU 72 includes an accelerometer, a gyroscope, and a magnetometer. In some embodiments, the first output from the IMU 72 comprises a 3-axis acceleration, a 3-axis angular rate of rotation (including an estimated yaw rate of change), and a 3-axis magnetic field strength. In the illustrated embodiment, the IMU 72 is positioned within the hull 14. Specifically, the IMU 72 is positioned in a bow portion 16 of the hull 14. Advantageously, the IMU 72 is positioned away from other electromagnetic systems that may interfere with or distort the local magnetic field measurements (e.g., the IMU 72 is positioned away from the motor 26. In some embodiments, the second output from the IMU 72 has been calibrated for iron cancellations (e.g., hard iron cancellations and soft iron cancellations) to neutralize the effects of nearby metallic objects, etc.

In some embodiments, an estimated speed, an estimated yaw, and an estimated yaw rate of change of the watercraft 10 is determined by the processor 30 based on the first output from the GPS system 64 and the second output from the IMU 72. Advantageously, the fusion of measurements from the GPS system 64 and the IMU 72 provides a robust estimation of the state of the watercraft. In some embodiments, the heading and yaw rate of the watercraft are provided by fusing GPS speed and course with an IMU accelerometer and magnetometer. This has the benefit of being robust to GPS connectivity issues under bridges and structures and being robust to the fact that GPS course only works reliably when the boat is moving above a certain speed.

In some embodiments, the watercraft 10 includes a compass 76 configured to measure, among other things, a heading of the watercraft 10. In the illustrated embodiment, the GPS system 64, the IMU 72, and the compass 76 are in electrical communication with the processor 30.

In some embodiments, the watercraft 10 further comprises a camera that captures images of the surroundings of the watercraft 10. In some embodiments, the watercraft 10 includes a plurality of cameras 80A-80C positioned with various fields of views around the watercraft 10. In the illustrated embodiment, the watercraft 10 includes a bow camera 80A, a stern camera 80B, and a tower camera 80C. The cameras 80A-80C are in electrical communication with the processor 30. In some embodiments, the processor 30 operates one or more thrusters 54, 58 based on feedback from the camera 80. In some embodiments, the processor 30 adjusts the output power of the thrusters 54, 58 in a closed-loop manner based on a desired trajectory with feedback from the camera 80.

In some embodiments, the propeller 22 is energized at a rotational speed based on a throttle position of the throttle 42 to provide a propelling force on the hull 14. The rotational direction of the propeller 22 is determined by a forward or reverse direction selected by the user at the motion selector 38, for example. However, the forces generated by the propeller 22 are not purely along the bow-stern axis 18 and also includes a drifting force (e.g., prop walk) acting on the watercraft 10. The drifting force from the propeller 22 can cause drifting of the watercraft 10 from a desired trajectory. As disclosed herein, at least one of the first thruster 54 or the second thruster 58 is energized to negate the drifting force caused by the propeller 22 to prevent any drifting motion of the watercraft 10 away from the desired trajectory. In some embodiments, both the first thruster 54 and the second thruster 58 are energized to negate the drifting force of the propeller 22. As such, one or more of the thrusters 54, 58 are utilized to correct for any prop wash, prop walk, or drifting motion caused by the propeller 22 and the rudder 46.

In some embodiments, a throttle (e.g., output power) of the first thruster 54, a throttle (e.g., output power) of the second thruster 58, a position of the rudder 46 about the rudder axis 50, and a throttle (e.g., output power) of the propeller 22 are adjustable by the processor 30. In other words, in the illustrated embodiment, the processor 30 adjusts operations of the first thruster 54, the second thruster 58, the rudder 46, and the propeller 22 based on a desired trajectory of the watercraft 10. In the illustrated embodiment, the processor 30 operates and controls at least four adjustable components (e.g., the thrusters 54, 58, the rudder 46, and the propeller 22) to achieve the desired trajectory of the watercraft 10. In some embodiments, the processor 30 operates and controls any number of adjustable components to achieve the desired trajectory of the watercraft.

In some embodiments, the processor 30 operates one or more thrusters 54, 58 based on a look-up table stored in a memory, for example. In some embodiments, the controller 30 adjust the output power of the thrusters 54, 58 in an open loop manner. In some embodiments, the look-up table is based on the throttle 42, the direction selected by the operate at the motion selector 38, or any combination thereof.

With reference to FIG. 3, as one example, the positions along the bow-stern axis 18 of the first thruster 54, the propeller 22, and the second thruster 58 are approximately 4.97 meters, 0.61 meters, and −0.12 meters, respectively (with "0 meters" being between the propeller 22 and the second thruster 58). Considering when the watercraft 10 is traveling in a reverse direction and the propeller 22 provides propelling force along the bow-stern axis 18 of approximately −500 N. In addition, the propeller 22 causes drifting force (e.g., in the starboard 2 or the port 4 direction) of approximately 100 N. Based on operation of propeller 22 alone, the watercraft 10 may drift from the desired trajectory. As disclosed herein, to correct for the drifting motion (e.g., negate the drifting force caused by the propeller), the first thruster 54 and the second thruster 58 are energized. As one example, the first thruster 54 is energized based on a look-up table to create a force of approximately −14.3 N on the watercraft 10, and the second thruster 58 is energized based on a look-up table to create a force of approximately −85.7 N on the watercraft 10. In combination, the first thruster 54 and the second thruster 58 negate the approximately 100 N drifting force caused by the propeller. As such, the watercraft 10 moves along the desired trajectory without any drifting motion.

In some embodiments, the processor 30 operates one or more thrusters 54, 58 based on feedback sensed from one or more of the GPS system 64 and the IMU 72. In some embodiments, the first thruster 54 or the second thruster 58 is energized based on the first output from the GPS system 64 and the second output from the IMU 72. In some embodiments, both the first thruster 54 and the second thruster 58 are energized based on the first output from the GPS system 64 and the second output from the IMU 72. In some embodiments, the processor 30 operates one or more thrusters 54, 58 based on feedback sensed from one or more of the GPS system 64, the IMU 72, and the compass 76. In some embodiments, the controller 30 adjusts the output power of the thrusters 54, 58 in a closed-loop manner based on a desired trajectory with feedback from one or more of the GPS system 64, the IMU 72, and the compass 76.

In some embodiments, the processor 30 executes one or more thrusters 54, 58 for closed-loop control of yaw rate of change. The processor 30 is further configured to determine a desired yaw rate of change of the hull. In some embodiments, the desired yaw rate of change of the hull is based on the position of the user input device and the estimated speed. The first thruster 54 and the second thruster 58 are energized based on an error between the desired yaw rate of change and the estimated yaw rate of change. In other words, a closed loop controller may maintain a desired yaw rate based on user input (e.g., the steering wheel angle) and the state of the watercraft. Information about the state of the watercraft utilized by the closed-loop controller may include for example, estimated speed, estimated yaw, estimated yaw rate of change, direction of movement, motor speed, motor torque, and throttle state. In some embodiments, the output force from the thrusters 54, 58 is variable based on, in part, the state of the watercraft 10. The processor 30 utilizes the inputs to determine the required thruster moment necessary to minimize the yaw rate of change error.

Figure 5:
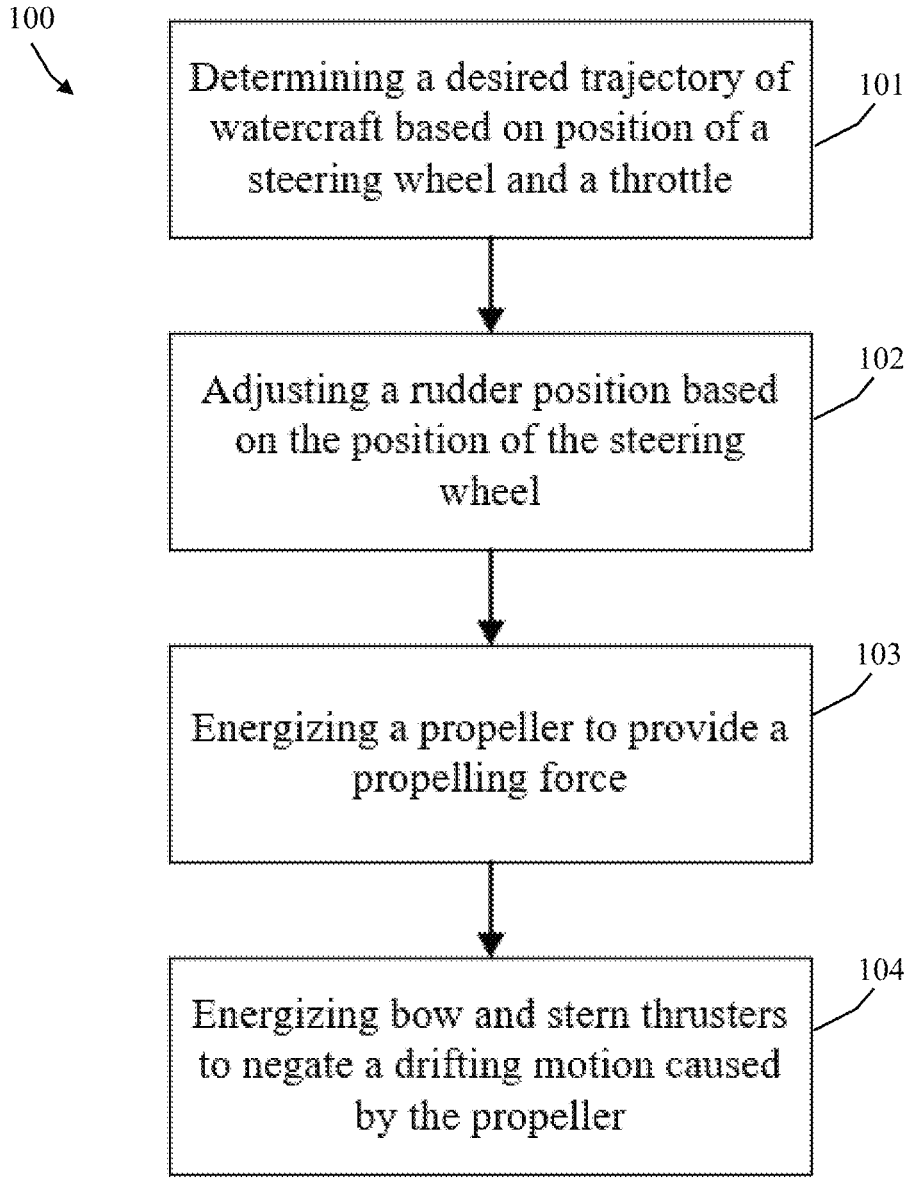
FIG. 5 is a flowchart of a method of steering a watercraft.

With reference to FIG. 5, a method 100 of steering a watercraft includes (STEP 101) determining a desired trajectory of a hull of a watercraft based on a position of a user input (e.g., user input device 34, motion selector 38, throttle 42, etc.). In some embodiments, STEP 101 includes determining a desired trajectory of a hull of a watercraft based on a position of a steering wheel and a position of a throttle. In some embodiments, the desired trajectory is a reverse trajectory. In some embodiments, the desired trajectory is a forward trajectory. As such, the method 100 disclosed herein is utilized for steering in both forward and reverse directions. In some embodiments, determining the desired trajectory includes determining whether an operator has selected a forward motion or a reverse motion (e.g., an input to the motion selector 38 or displacement direction of the throttle 42). In some embodiments, the user input is a steering wheel. In some embodiment, the hull defines a center bow-stern axis (e.g., axis 18), and the propeller is positioned along the center bow-stern axis.

The method 100 further includes (STEP 102) adjusting a position of a rudder coupled to the hull based on the position of the steering wheel. In some embodiments, adjusting the rudder includes rotating the rudder about a rudder axis.

The method 100 further includes (STEP 103) energizing a propeller based on the position of the throttle to provide a propelling force on the hull. As disclosed herein, the propeller may also create an undesirable drifting force.

The method 100 further includes (STEP 104) energizing at least one thruster coupled to the hull to negate a drifting force caused by the propeller and thereby preventing a drifting motion from the desired trajectory. In some embodiments, energizing the thruster to negate the driving motion is at least partially based on the position of the user input. In some embodiments, the thruster is a first thruster, and the method 100 further includes energizing a second thruster coupled to the hull to negate the drifting motion. In some embodiments, the propeller is positioned between the first thruster and the second thruster. In some embodiments, the propeller is one of a plurality of propellers.

In some embodiments, the method 100 further comprises determining an estimated drifting motion caused by the propeller based on a first output from a GPS system and a second output from an inertial measurement unit. In some embodiments, energizing the thruster to negate the drifting motion is at least partially based on a measured position or orientation of the watercraft. In some embodiments, the method 100 further comprises capturing an image with a camera of a surrounding of the watercraft. In some embodiments, energizing the thruster to negate the drifting motion is at least partially based on the image. In some embodiments, the method 100 adjusts operation of the thruster based on feedback from a sensing device (e.g., GPS system 64, IMU 72, compass 76, camera 80, etc.). In some embodiments, the method 100 is performed by the processor 30 based on instructions stored in the memory 32.

Advantageously, the systems and methods disclosed herein ensure that for forward and reverse trajectories, a steering wheel provides a constant radius of curvature for a given throttle position (with a straight-line trajectory having an infinite radius of curvature). As such, the watercraft steering feels to an operator like a car, for example, such that the watercraft tracks consistently relative to wheel and throttle positions instead of slipping or drifting through the water.

Figure 6:
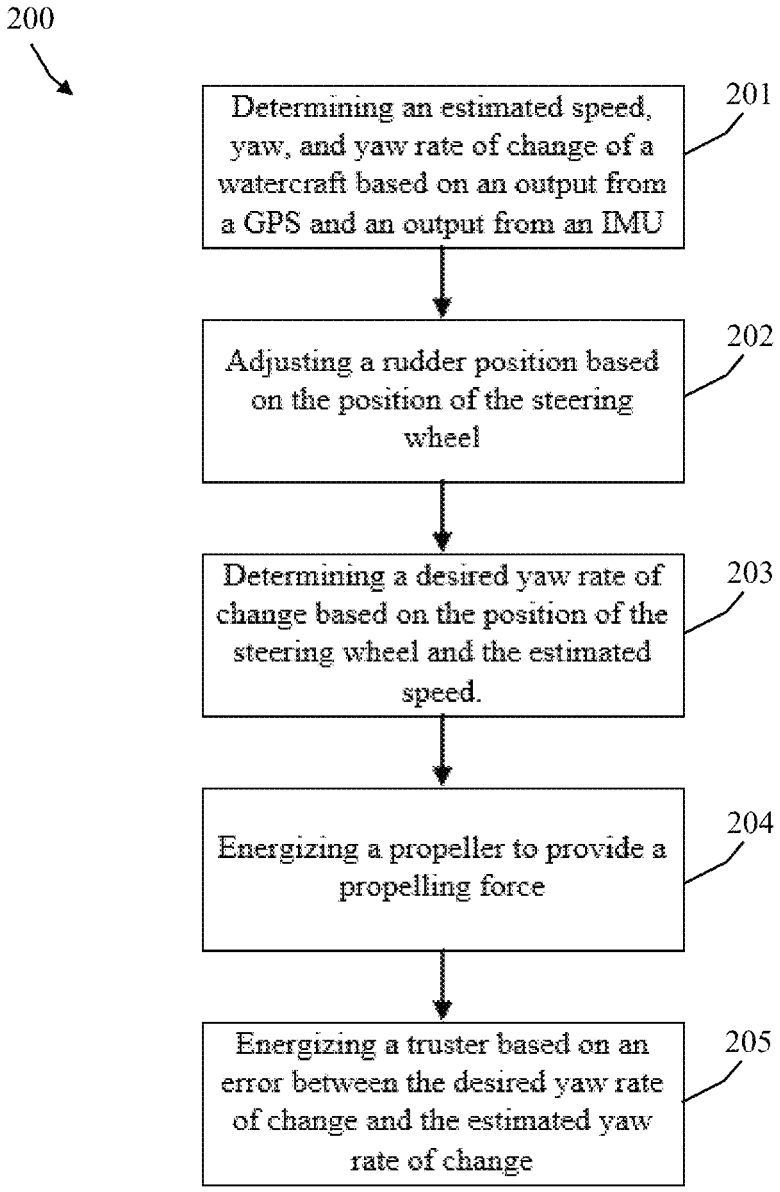
FIG. 6 is a flowchart of a method of steering a watercraft.

With reference to FIG. 6, a method 200 of steering a watercraft includes (STEP 201) determining an estimated speed, an estimated yaw, and an estimated yaw rate of change of a watercraft based on a first output from a GPS and a second output from an IMU. In some embodiments, one or more of the estimated speed, the estimated yaw, and the estimated yaw rate of change are determined with a fusion (e.g., by an extended Kalman filter) of the first output form the GPS and the second output from the IMU. In some embodiments, the estimated yaw rate of change is determined with only the second output from the IMU. In some embodiments, the method 200 further comprises determining an estimated course of the watercraft based on the first output from the GPS and the second output from the inertial measurement unit.

The method 200 further includes (STEP 202) adjusting a position of a rudder coupled to a hull of the watercraft based on a position of a steering wheel.

The method 200 further includes (STEP 203) determining a desired yaw rate of change of the hull based on the position of the steering wheel and the estimated speed. In some embodiments, determining the desired yaw rate of change is based on the position of the steering wheel, the estimated speed, and the estimated course. In some embodiments, the desired yaw rate of change is inversely correlated to the estimated speed.

The method 200 further includes (STEP 204) energizing a propeller to provide a propelling force on the hull.

The method 200 further include (STEP 205) energizing a thruster coupled to the hull based on an error between the desired yaw rate of change and the estimated yaw rate of change. In some embodiments, the thruster is a first thruster and the method 200 further includes energizing a second thruster coupled to the hull based on the error between the desired yaw rate of change and the estimated yaw rate of change.

In the illustrated embodiment, the watercraft 10 is a boat. In other embodiments, the watercraft is a fishing boat, a dingy boat, a deck boat, a bowrider boat, a catamaran boat, a cuddy cabin boat, a center console boat, a houseboat, a trawler boat, a cruiser boat, a game boat, a yacht, a personal watercraft boat, a water scooter, a jet-ski, a runabout boat, a jet boat, a wakeboard, a ski boat, a life boat, a pontoon boat, or any suitable motor boat, vessel, craft, or ship. Although examples are illustrated with respect to an all-electric watercraft, the methods and systems described herein can also be used in a conventional motorboat application (e.g., with a gasoline or diesel-powered engine).

Various features and advantages are set forth in the following claims.

What is claimed is:

1. A method comprising:

determining an estimated speed, an estimated yaw, and an estimated yaw rate of change of a watercraft based on a first output from a Global Positioning System (GPS) and a second output from an inertial measurement unit;

adjusting a position of a rudder coupled to a hull of the watercraft based on a position of a steering wheel;

determining a desired yaw rate of change of the hull based on the position of the steering wheel and the estimated speed; energizing a propeller to provide a propelling force on the hull; and energizing a thruster coupled to the hull based on an error between the desired yaw rate of change and the estimated yaw rate of change.

2. The method of claim 1, wherein the estimated speed and the estimated yaw of the watercraft is determined with a fusion of the first output from the GPS and the second output from the inertial measurement unit.

3. The method of claim 2, wherein the fusion of the first output from the GPS and the second output from the inertial measurement unit is with an extended Kalman filter.

4. The method of claim 1, wherein the first output from the GPS comprises a GPS-estimated speed, a GPS-estimated latitude, a GPS-estimated longitude; a GPS-estimated altitude; a GPS-estimated course; and a dilution of precision.

5. The method of claim 1, wherein the second output from the inertial measurement unit includes 3-axis acceleration; 3-axis angular rate of rotation, and 3-axis magnetic field strength.

6. The method of claim 5, wherein the inertial measurement unit is positioned within the hull; and the second output from the inertial measurement unit has been calibrated for iron cancellations.

7. The method of claim 1, further comprising determining an estimated course of the watercraft based on the first output from the GPS and the second output from the inertial measurement unit; and wherein determining the desired yaw rate of change is based on the position of the steering wheel, the estimated speed, and the estimated course.

8. The method of claim 1, wherein the desired yaw rate of change is inversely correlated to the estimated speed.

9. The method of claim 1, wherein the thruster is a first thruster and the method further includes energizing a second thruster coupled to the hull based on the error between the desired yaw rate of change and the estimated yaw rate of change; and wherein the propeller is positioned between the first thruster and the second thruster.

10. A watercraft comprising:

a hull defining a center bow-stern axis;

a user input device;

a throttle;

an inboard motor coupled to a propeller; wherein the propeller is positioned along the center bow-stern axis; and wherein the propeller is energized based on a throttle position of the throttle to provide a propelling force on the hull;

a first thruster coupled to the hull;

a second thruster coupled to the hull; wherein the propeller is positioned between the first thruster and the second thruster along the center bow-stern axis;

a rudder coupled to the hull and adjustable about a rudder axis; wherein the rudder is positioned based on a position of the user input device;

a Global Positioning System (GPS) system generating a first output;

an inertial measurement unit generating a second output; and a processor configured to determine an estimated speed, an estimated yaw, and an estimated yaw rate of change based on the first output from the GPS system and the second output from the inertial measurement unit; and wherein the processor is further configured to determine a desired yaw rate of change of the hull based on the position of the user input device;

wherein the first thruster or the second thruster is energized based on an error between the desired yaw rate of change and the estimated yaw rate of change.

11. The watercraft of claim 10, wherein the first thruster and the second thruster are energized based on the first output and the second output.

12. The watercraft of claim 10, wherein the first thruster or the second thruster is energized to negate a drifting motion caused by the propeller.

13. The watercraft of claim 10, wherein a throttle of the first thruster, a throttle of the second thruster, a position of the rudder about the rudder axis, and a throttle of the propeller are adjustable by the processor.

14. The watercraft of claim 10, wherein the user input device is a steering wheel.

15. The watercraft of claim 10, wherein the inertial measurement unit is positioned in a bow portion of the hull.

16. The watercraft of claim 10, further comprising a camera that captures an image of a surrounding of the watercraft; and wherein the first thruster or the second thruster is energized based on the image.

17. The watercraft of claim 10, wherein the first thruster and the second thruster have an adjustable output power; and wherein an orientation of the first thruster and an orientation of the second thruster are fixed relative to the hull.

18. A method comprising:

determining a desired trajectory of a hull of a watercraft based on a position of a steering wheel and a position of a throttle; wherein the desired trajectory is a reverse trajectory or a forward trajectory;

adjusting a position of a rudder coupled to the hull based on the position of the steering wheel;

energizing a propeller based on the position of the throttle to provide a propelling force on the hull; and energizing a first thruster and a second thruster coupled to the hull to negate a drifting motion of the hull caused by the propeller; wherein the propeller is positioned between the first thruster and the second thruster.

19. The method of claim 18, further comprising determining an estimated drifting motion caused by the propeller based on a first output from a Global Positioning System (GPS) and a second output from an inertial measurement unit.

20. The method of claim 18, wherein the first thruster is energized to produce a first force magnitude on the hull and the second thruster is energized to produce a second force magnitude on the hull different from the first force magnitude.

* * * * *